US005970683A

United States Patent [19]

Miyamoto et al.

[11] Patent Number: 5,970,683

[45] Date of Patent: Oct. 26, 1999

[54] COIN WRAPPING MACHINE

[75] Inventors: Katsuyuki Miyamoto, Kawaguchi; Nobushige Horiguchi, Fukiage-machi; Syouichi Uda, Tokyo, all of Japan

[73] Assignee: Laurel Bank Machines Co., Ltd., Tokyo, Japan

[21] Appl. No.: 08/991,057

[22] Filed: Dec. 15, 1997

[30] Foreign Application Priority Data

Dec. 20, 1996 [JP] Japan ..... 8-342241
Dec. 12, 1997 [JP] Japan ..... 9-343126

[51] Int. Cl.[6] ..... B65B 11/04

[52] U.S. Cl. ..... 53/212; 53/532; 53/201; 53/501; 53/504

[58] Field of Search ..... 53/168, 201, 501, 53/502, 503, 504, 212, 532

[56] References Cited

U.S. PATENT DOCUMENTS

| | | | |
|---|---|---|---|
| 3,908,338 | 9/1975 | Ushio | 53/212 |
| 3,938,303 | 2/1976 | Ushio et al. | 53/212 |
| 4,038,806 | 8/1977 | Rothman et al. | 53/212 X |
| 4,069,647 | 1/1978 | Horie . | |
| 4,729,211 | 3/1988 | Sakurai | 53/212 X |
| 5,155,978 | 10/1992 | Watanabe | 53/212 X |
| 5,435,113 | 7/1995 | Oikawa | 53/212 |
| 5,487,252 | 1/1996 | Ozeki et al. | 53/212 |

FOREIGN PATENT DOCUMENTS

| | | |
|---|---|---|
| 2340854 | 9/1977 | France . |
| 8-113207 | 7/1996 | Japan . |
| 1 476 474 | 6/1977 | United Kingdom . |
| 2 072 129 | 9/1981 | United Kingdom . |

OTHER PUBLICATIONS

Patent Abtracts of Japan, vol. 096, No. 009, Sep. 30, 1996 & JP 08 113207 A (Laurel Bank Mach. Co., Ltd.), May 7, 1996.

*Primary Examiner*—Daniel B. Moon
*Attorney, Agent, or Firm*—Frishauf, Holtz, Goodman, Langer & Chick, P.C.

[57] ABSTRACT

A coin wrapping machine includes a coin denomination selecting device for selecting the denomination of coins to be wrapped, a coin discrimination and counter device for discriminating and counting the coins to be wrapped, a coin stacking device for stacking a predetermined number of coins, a coin wrapping device for wrapping a wrapping paper around the stacked coins and crimping both ends of the wrapping paper, and a speed setting device for setting the operating speed of wrapping rollers to a predetermined speed and setting the moving speed of a crimping device to a predetermined speed.

6 Claims, 5 Drawing Sheets

COIN WRAPPING MACHINE

BACKGROUND OF THE INVENTION

1. Field of the Invention

The present invention relates to a coin wrapping machine, in particular to a coin wrapping machine for wrapping coins with various shapes including circular coins, polygonal coins and the like.

2. Description of the Related Art

A conventional coin wrapping machine is disclosed in Japanese Patent Laid-Open No. 8-113207. The coin wrapping machine disclosed in this Japanese Patent is provided with a rotatable disc for delivering deposited coins to a transport passage, stacking drums for stacking the coins which are transported on the transport passage and whose numbers are counted, wrapping rollers for wrapping a wrapping paper around the stacked coins, and a pair of upper and lower crimp claws for crimping upper and lower ends of the wrapping paper to produce a roll of wrapped coins.

In this conventional coin wrapping machine, the coins deposited on the rotatable disc are delivered one by one by centrifugal force to the transport passage disposed on the circumferential side of the disc, are discriminated and counted, and transported to the stacking drums. The stacking drums stack a predetermined number of the coins to produce columnar stacked coins, and the stacked coins are thereafter moved to the wrapping rollers and are gripped by the rollers. While the stack of coins is rotated about its longitudinal center axis by the wrapping rollers, the wrapping paper is supplied between the rollers and the stacked coins and is wrapped around the stacked coins, and then the crimp claws crimp the upper and lower ends of the wrapping paper to produce the roll of wrapped coins.

The above mentioned coin wrapping machine is a machine for wrapping circular coins, which are the only type used in some countries such as Japan. However, in some countries, polygonal coins are used as well as circular coins. If the above mentioned coin wrapping machine is used to wrap polygonal coins, the contact pressure between the stacked coins and the circumferential surfaces of the rollers when the stacked polygonal coins are being rotated between the rollers fluctuates owing to the ups and downs along the circumferential surfaces of the polygonal coins. The fluctuating contact pressure vibrates the stacked polygonal coins and may cause them to fly out from the wrapping rollers. Accordingly, the conventional coin wrapping machine cannot reliably wrap polygonal coins.

Further, when the coin wrapping machine wraps stacked coins, the diameters of the coins, quality of the wrapping paper and the like have to be taken into consideration.

SUMMARY OF THE INVENTION

It is therefore an object of the present invention to provide a coin wrapping machine which can reliably wrap stacked coins based on the denominations of the coins to be wrapped.

It is another object of the present invention to provide a coin wrapping machine which can reliably wrap polygonal coins as well as ordinary circular coins without causing the polygonal coins to fly out during the wrapping operation.

This and other objects are achieved according to the present invention by providing a coin wrapping machine comprising coin denomination selecting means for selecting a denomination of coins to be wrapped, coin discrimination and counter means for discriminating and counting the coins whose denomination is selected by the coin denomination selecting means, coin stacking means for stacking a predetermined number of coins discriminated and counted by the coin discrimination and counter means to produce columnar stacked coins, coin wrapping means for wrapping a wrapping paper around the stacked coins and crimping both ends of the wrapping paper to produce wrapped coins, said coins wrapping means including a plurality of wrapping rollers which rotate about longitudinal shafts thereof while gripping a circumferential surface of the stacked coins, wrapping roller drive means connected with at least one of the wrapping rollers for rotating the wrapping rollers at variable speed, a pair of crimping means for crimping wrapping paper of the stacked coins by moving close to both ends of the wrapped stacked coins, and crimping means drive means for moving the crimping means at variable speed, and speed setting means for setting an operating speed of the wrapping rollers to a predetermined speed and setting a moving speed of the crimping means to a predetermined speed associated with the predetermined speed of the wrapping rollers by controlling the wrapping roller drive means and the crimping means drive means.

In a preferred embodiment of the present invention, the speed setting means sets the operating speed of the wrapping rollers and the moving speed of the crimping means to be lower when the coin whose denomination is selected by the coin denomination selecting means is a polygonal coin than it is a circular coin.

In a further preferred embodiment of the present invention, the speed setting means sets the operating speed of the wrapping rollers and the moving speed of the crimping means to be lower when the wrapping rollers roll on the circumferential surface of the stacked coins.

In a still further preferred embodiment of the present invention, the speed setting means sets the operating speed of the wrapping rollers and the moving speed of the crimping means to predetermined speeds for the individual denominations of the coins.

In a still further preferred embodiment of the present invention, the speed setting means sets the operating speed of the wrapping rollers and the moving speed of the crimping means to be higher with increasing diameter of the coin whose denomination is selected by the coin denomination selecting means.

In a still further preferred embodiment of the present invention, the coin wrapping machine further comprises paper quality discrimination means for discriminating the wrapping paper, the speed setting means setting the operating speed of the wrapping rollers and the moving speed of the crimping means based on the paper quality discriminated by the paper quality discrimination means.

The above and other objects and features of the present invention will be apparent from the following description by taking reference with accompanying drawings employed for preferred embodiments of the present invention.

DESCRIPTION OF THE PREFERRED EMBODIMENTS

The present invention will now be explained with reference to preferred embodiments and the drawings.

Figure 1:
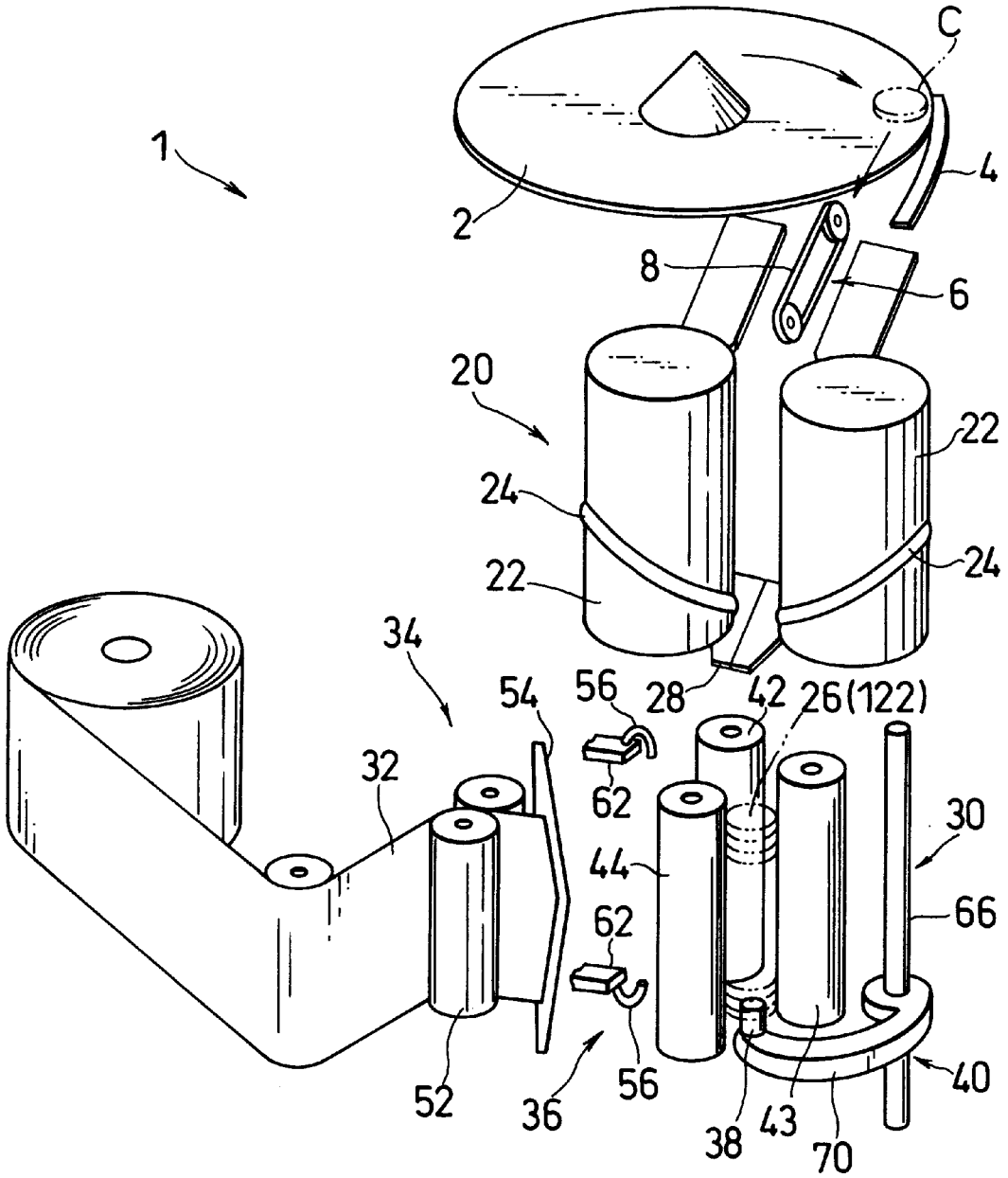
FIG. 1 is a schematic perspective view showing a coin wrapping machine in accordance with a preferred embodiment of the present invention.

Referring to FIG. 1, a coin wrapping machine 1 in accordance with a preferred embodiment includes a rotatable disc 2 on which a large number of deposited coins C are received. A guide plate 4 is located at a circumferential portion of the rotatable disc 2 so as to guide the coins C pushed tangentially outward from the disc 2 by the rotation of the rotatable disc 2. A transport passage 6 for aligning and guiding the coins C is disposed so as to connect with the guide plate 4, and a transport belt 8 is disposed above the transport passage 6 to transport the coins C along the transport passage 6.

A discrimination and counter section 10 (see FIG. 5) includes a discrimination sensor 12 and a counter sensor 14 both of which are provided in the transport passage 6. The discrimination sensor 12 discriminates the deposited coins C as to whether or not their denominations agree with the denomination of the coin selected in a denomination selecting section 16 and removes counterfeit coins and coins whose denominations are different from the selected one. The counter sensor 14 counts only the number of coins of the selected denomination.

The denomination selecting section 16 is provided to enable selection of the denomination of coins to be wrapped. An operator inputs a denomination to the denomination selecting section 16 before the wrapping operation starts. The denomination selecting section 16 is also used when the coin denomination has to be changed.

Further, a stop 18 (see FIG. 5) is disposed on the transport passage 6 to stop the flow of the coins C on the passage 6.

A coin stacking section 20 is disposed at the distal end of the transport passage 6. The coin stacking section 20 is provided with a pair of stacking drums 22 which guide the coins C transported from the transport passage 6 downward while stacking the coins C one by one. The stacking drums 22 are disposed in parallel and have a space between their respective circumferential surfaces which is slightly smaller than the diameter of a coin. Screw-like projections 24 extending in the opposite directions are formed on the circumferential surfaces of the drums 22. The stacking drums 22 are continuously and synchronously rotated in opposite directions as the coins C are fed from the transport passage 6, while the projections 24 thereof are maintained at the same height.

The coins C moves downward in the stacking section 20 with its circumferential edge portions supported by the projections 24 of the drums 22, and is stacked on the previously stacked coin C. Thus, a stack of the coins 26 is produced.

Under the stacking drums 22 is disposed a shutter 28 on which stacked coins 26 of a predetermined number (for example 50) are received.

A coin wrapping section 30 is located under the shutter 28. The coin wrapping section 30 includes a wrapping mechanism 34 which supplies a wrapping paper 32 to the stacked coins 26 and winds the wrapping paper 32 around the stacked coins 26, and a crimp mechanism 36 which crimps the wrapping paper 32 wrapped around the stacked coins 26 at the upper and lower end portions of the stacked coins 26.

The coin wrapping section 30 further includes a supporting post 38 and a supporting post drive mechanism 40. The supporting post 38 is movable vertically and disposed so as to receive the stacked coins 26 from the shutter 28 and to support the stacked coins 26 under the shutter 28. The supporting post drive mechanism 40 is disposed so as to move the supporting post 38 between a waiting position where the supporting post 38 receives the stacked coins 26 from the shutter 28, a wrapping position where the wrapping mechanism 34 wraps the stacked coins 26 and an escape position which is located under the waiting position.

Figure 2:
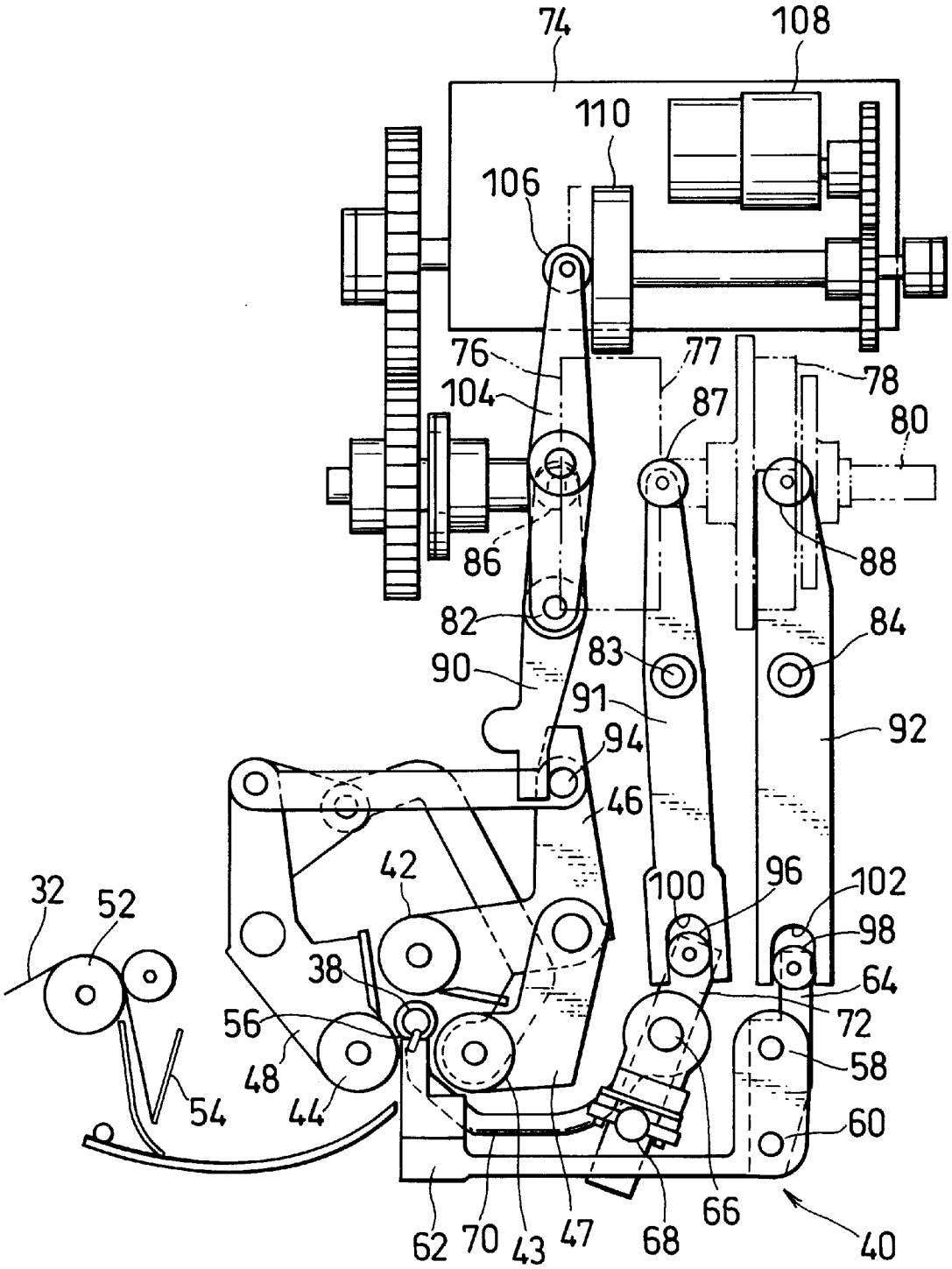
FIG. 2 is a plan view showing the inner mechanism of a coin wrapping device of the coin wrapping machine of FIG. 1.

Referring to FIGS. 1 and 2, the wrapping mechanism 34 includes three wrapping rollers 42, 43 and 44 which grip in the radial direction the stacked coins 26 transported from the coin stacking section 20 to the coin wrapping section 30 by the supporting post drive mechanism 40. These wrapping rollers 42, 43 and 44 are rotatably mounted on roller supporting arms 46, 47 and 48 and are disposed to move toward each other so as to contact the circumferential surface of the stacked coins 26 and to move away from the stacked coins 26 by the swinging actions of the arms 46, 47 and 48.

The wrapping mechanism 34 further includes a pair of wrapping paper feeding rollers 52 driven by a paper feeding motor 50 (see FIG. 5) to feed the wrapping paper 32, and a cutter 54 which cuts the fed wrapping paper 32 having a length for two windings.

The crimp mechanism 36 includes a pair of crimp claws 56 which move toward each other so as to approach the stacked coins 26 from the upper and lower directions and crimp the upper end and lower end of the wrapping paper 32 under the condition that the wrapped stacked coins 26 are gripped between the wrapping rollers 42, 43 and 44. The crimp claws 56 are mounted on the distal portions of crimp claw arms 62 which are vertically movable along a center shaft 58 and a guide shaft 60 both of which are vertically disposed. The center shaft 58 and the guide shaft 60 are connected with a swing member 64 which is swingable about the center shaft 58 in the horizontal direction.

The supporting post drive mechanism 40 having the supporting post 38 on its distal end includes a support arm 70 which is vertically movable along a center shaft 66 and a guide shaft 68 both of which are vertically disposed, and a swing member 72 with which the center shaft 66 and the guide shaft 68 are connected and which is swingable about the center shaft 66 in the horizontal direction.

The wrapping mechanism 34, the crimp mechanism 36 and the supporting post drive mechanism 40 are all connected with a single cam motor 74 and are therefore driven by a cam shaft 80 having cams 76, 77 and 78. Namely, the mechanisms 34, 36 and 40 respectively include swing levers 90, 91 and 92 which are respectively swingable about vertical shafts 82, 83 and 84. Rotatable cam followers 86, 87 and 88 are respectively mounted on one ends of the levers 90, 91 and 92, and the other ends of the levers 90, 91 and 92 are respectively connected with the roller supporting arm 46 and the swing members 72 and 64. The other end of the swing lever 90 contacts a vertical shaft 94 of the roller supporting arm 46, and the swing levers 91 and 92 respectively have U-shaped notched portions 100 and 102 into which rollers 96 and 98 rotatably mounted on the distal ends of the swing members 72 and 64 are respectively engaged.

The cam followers 86, 87 and 88 of the swing levers 90, 91 and 92 are biased by a biasing device (not shown) so as to constantly contact with the cam surfaces of the respective cams 76, 77 and 78 of the cam shaft 80, and the swing levers 90, 91 and 92 swing by following the cam profiles formed on the cam surfaces of the cams 76, 77 and 78.

The vertical shaft 82 of the swing lever 90 of the wrapping mechanism 34 is rotatably mounted on one end of another swing lever 104 which has a cam follower 106 on its other end. The cam follower 106 is maintained in constant contact with a cam 110 of a denomination selecting motor 108 by a spring (not shown). The denomination selecting motor 108 is adapted to adjust the wrapping positions of the wrapping rollers 42, 43 and 44 based on the diameter of the coin C whose denomination is selected by the denomination selecting section 16.

Figure 3:
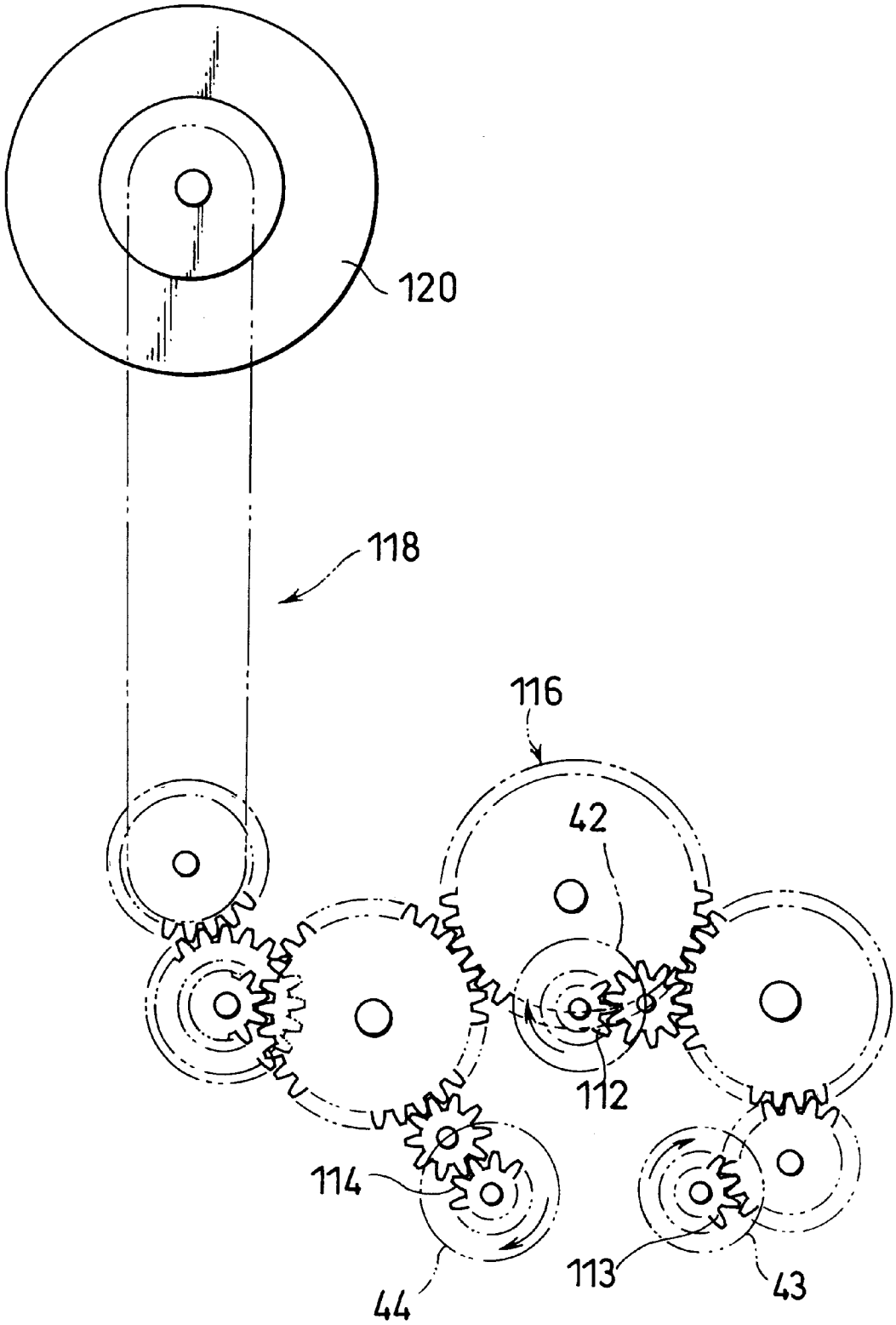
FIG. 3 is a schematic plain view showing a drive mechanism of wrapping rollers of the coin wrapping machine of FIG. 1.

Referring to FIG. 3, the wrapping rollers 42, 43 and 44 are respectively provided with gears 112, 113 and 114 which are connected with a wrapping motor 120 through a gear train 116 and a pulley belt 118. Thus, when the wrapping motor 120 rotates, the wrapping rollers 42, 43 and 44 are driven synchronously to rotate in the same direction.

The cam motor 74 and the wrapping motor 120 are variable speed motors such as pulse motors whose speed varies with phase number.

The crimp claws 56 and the supporting post 38 are respectively connected with the distal ends of other swing levers (not shown) which are vertically swingable by following other cams (not shown) mounted on the camshaft 80. Thus, the crimp claws 56 and the supporting post 38 are moved upward and downward by the up and down movements of the distal ends of these vertically swingable levers.

Figure 4:
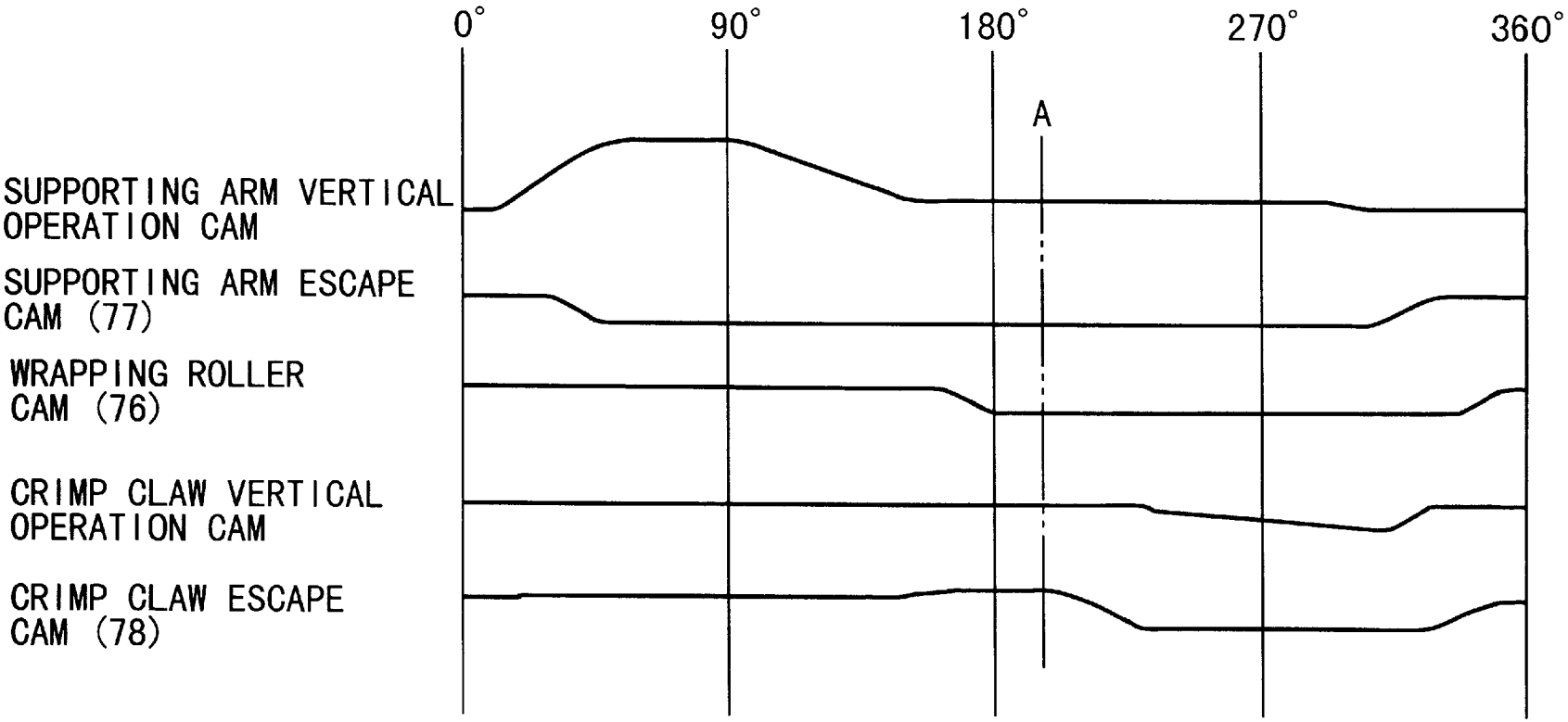
FIG. 4 is a cam diagram showing how various cams of the coin wrapping machine of FIG. 1 are operated.

FIG. 4 shows cam diagrams representing the cam operations of the various cams 76, 77, 78 and the like.

From the top to the bottom in FIG. 4, the cam diagrams of the supporting arm vertical operation cam for controlling the vertical movement of the supporting post 38, the supporting arm escape cam 77 for controlling the horizontal movement of the supporting post 38, the wrapping roller cam 76 for controlling the operation of the rollers 42, 43 and 44 to grip the stacked coins 26 and move away from the stacked coins 26, the crimp claw vertical operation cam for controlling the vertical movement of the crimp claw arms 62 provided with the crimp claws 56, and the crimp claw escape cam 78 for controlling the horizontal movement of the crimp claw arms 62 are respectively illustrated.

Regarding the cam diagram of the crimp claw vertical operation cam, only the cam diagram of the cam for the upper crimp claw 56 is shown and that for the lower crimp claw 56 is not shown, since the cam diagram for the lower crimp claw 56 is symmetrical in the vertical direction.

In FIG. 4, the initial position of the camshaft 80 of 0 degree is shown on the far left, and as the camshaft 80 rotates, the cam diagrams progress to the right, finally reaching the far right or 360 degrees where the camshaft 80 has made one rotation.

The supporting arm vertical operation cam makes the supporting post 38 move upward in the region between 10 degrees and 45 degrees, wait at the waiting position immediately under the shutter 28 in the region between 45 degrees and 90 degrees, move downward in the region between 90 degrees and 140 degrees, and move further downward to the wrapping position and the escape position in the region between 140 degrees and 360 degrees.

The supporting arm escape cam 77 makes the supporting post 38 move to the waiting position under the shutter 28 by rotating the guide shaft 68 clockwise about the center shaft 66 in the region between 30 degrees and 45 degrees, keep its horizontal position under the shutter 28 in the region between 45 degrees and 305 degrees, and move to the escape position apart from the wrapping rollers 42, 43 and 44 by rotating the guide shaft 68 counterclockwise about the center shaft 66 in the region 305 degrees and 330 degrees.

The wrapping roller cam 76 makes the wrapping rollers 42, 43 and 44 wait at their respective waiting positions where the rollers 42, 43 and 44 are mostly apart from each other in the region between 0 degree and 160 degrees, move toward each other in the region between 160 degrees and 180 degrees, grip and hold the stacked coins 26 in the region between 180 degrees and 330 degrees, and move away from each other to separate from the stacked coins 122 in the region between 330 degrees and 360 degrees.

The crimp claw vertical operation cam makes the crimp claws 56 move toward each other in the region between 230 degrees and 320 degrees, move away from each other in the region between 320 degrees and 335 degrees, and wait at the escape positions where the crimp claws 30 are most apart from each other in the regions between 0–230 degrees and 335–360 degrees.

The crimp claw escape cam 78 makes the crimp claws 56 wait at the escape position where the crimp claws 56 are horizontally apart from the wrapping rollers 42, 43 and 44 in the region between 0 degree and 180 degrees, move to positions above and below the space enclosed by the rollers 42, 43 and 44 by horizontally moving the crimp claw arms 62 in the region between 180 degrees and 210 degrees, wait at these positions in the region between 210 degrees and 330 degrees, and escape horizontally from the rollers 42, 43 and 44 in the region between 330 degrees and 360 degrees.

Figure 5:
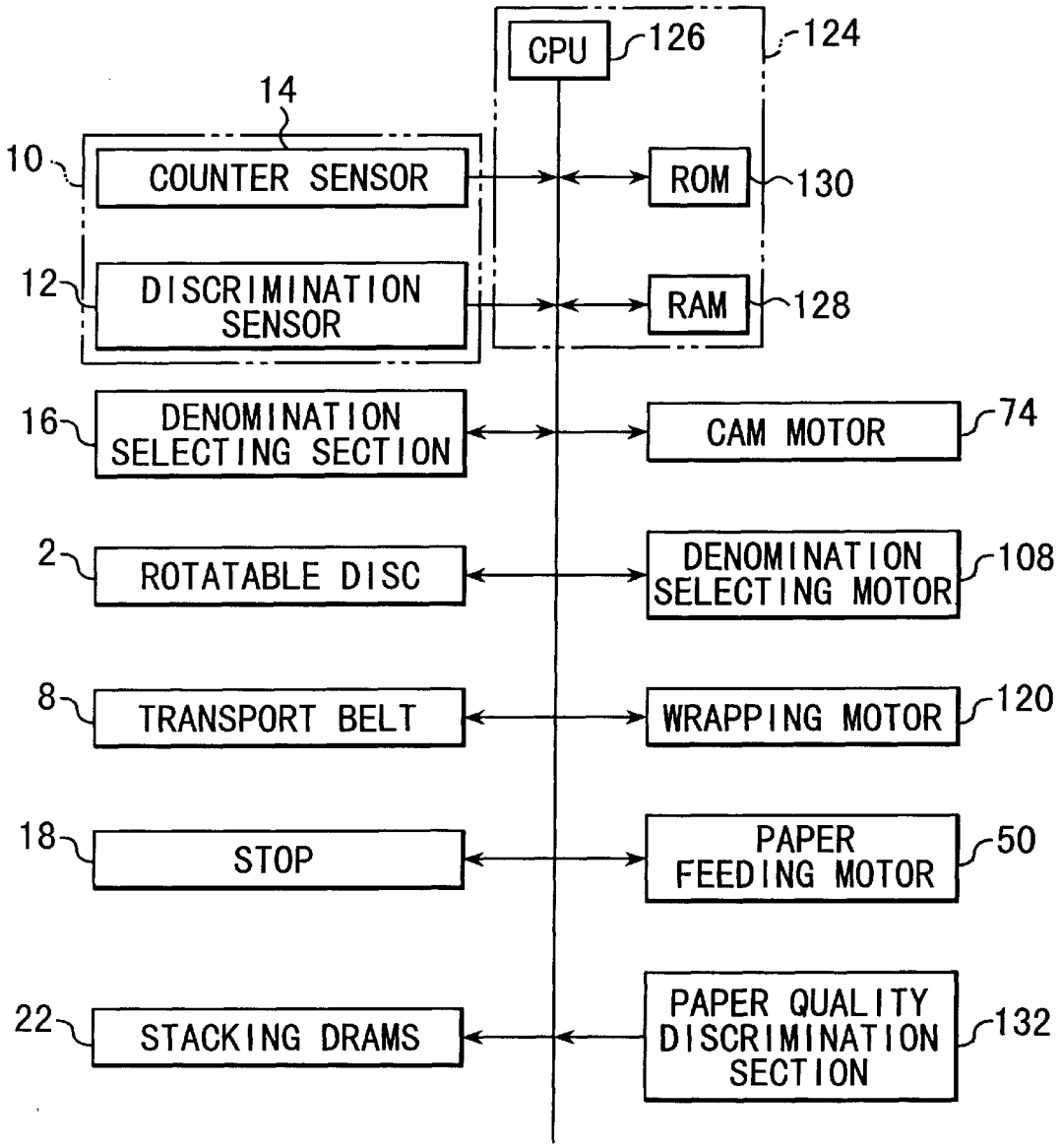
FIG. 5 is a block diagram of the control of the coin wrapping machine of FIG. 1.

Referring to FIG. 5, a controller 124 is provided with a CPU 126, a RAM 128 and a ROM 130. The ROM 130 stores standard data including the diameters and thicknesses of the coins C of the respective denominations, speed information explained below regarding the wrapping rollers and the crimp claws based on the shapes of the coins C, an operating program of the coin wrapping machine 1, and the like. The RAM 128 stores data including the denominations of the coins C, the counted numbers of the coins C, the number of stacked coins C, the operating conditions of the various motors and the like. The CPU 126 totally controls the coin wrapping machine 1 using the data stored in the RAM 128 and the ROM 130.

The controller 124 also works as a speed setting section which sets the speeds of the cam motor 74 and the wrapping motor 120 based on the denomination of the coin C selected by the denomination selecting section 16. Specifically, the speed setting section 124 operates when the coins C to be wrapped are not circular but, for example, polygonal. When the coins C to be wrapped are polygonal, for example, the speed setting section 124 sets the speeds of the cam motor 74 and the wrapping motor 120 based on the speed information associated with the selected denomination of the coin C stored in the ROM 130.

The operation of the speed setting section 124 starts at point A in FIG. 4 and finishes in the region between 330 degrees and 360 degrees in the cam diagram where the rollers 42, 43 and 44 are apart from each other. The point A in FIG. 4 is the time when the wrapping motor 120 and the cam motor 74 start the wrapping operation.

For example, when the coin C to be wrapped is circular, the cam motor 74 is operated at its maximum speed and without decreasing its speed at the point A and the wrapping motor 120 is also operated at its maximum speed.

On the other hand, when the coin C to be wrapped is polygonal, the wrapping motor 120 and the cam motor 74 are operated at speeds decreased to about 55 percent of their respective operating speeds when the coin C is circular.

In operation, an operator firstly uses the denomination selecting section 16 to select the denomination of the coin C to be wrapped. The selected denomination of the coin C is then sent to the controller 124 and stored in the RAM 128.

Then, the denomination selecting motor 108 is operated based on the selected denomination of the coin C so as to adjust the wrapping positions of the wrapping rollers 42, 43 and 44 based on the diameter of the coin C whose denomination is selected by the denomination selecting section 16.

When the coins C are deposited in bulk on the rotatable disc 2, the coins C are delivered one by one by centrifugal force to the transport passage 6 through the guide plate 4 disposed on the circumferential edge portion of the rotatable disc 2. The coins C on the transport passage 6 are transported by the transport belt 8 disposed above the passage 6 and are discriminated and counted when the coins C pass through the discrimination sensor 12 and the counter sensor 14.

At the moment the number of the coins C counted by the sensor 14 reaches to a predetermined value, the stop 18 is operated to close the transport passage 6. Therefore, the predetermined number of the coins C are sent to the coin stacking section 20 before the stop 18 is closed.

In the coin stacking section 20, the coins C coming from the transport passage 6 are successively supplied on the projections 24 of the stacking drums 22. The coins C are stacked between the drums 22 by the synchronous rotations of the drums 22. When the predetermined number of the coins C are stacked between the stacking drums 22, the stacked coins 26 are placed on the shutter 28 located under the drums 22 by further rotations of the stacking drums 22.

Further, when counting of the predetermined number of the coins C on the transport passage 6 is finished, the supporting post drive mechanism 40 is operated by the cam motor 74. Thus, the supporting post 38 is moved to the waiting position immediately under the shutter 28.

After the stacked coins 26 have been placed on the shutter 28, a shutter solenoid (not shown) is operated to open the shutter 28 so that the stacked coins 26 move onto the supporting post 38. Then, the stacked coins 26 are transported to the coin wrapping section 30 and placed between the wrapping rollers 42, 43 and 44 by the supporting post 38 being moved downward by the operation of the supporting post drive mechanism 40.

When the stacked coins 26 are placed at the wrapping position, the three wrapping rollers 42, 43 and 44 simultaneously move toward the circumferential surface of the coins 26 so as to contact the coins 26 and grip the circumferential surface of the coins 26 by the rotation of the cam motor 74, the rotation of the cam shaft 80 and the swinging movements of the swing lever 90 and the roller supporting arms 46, 47 and 48. Just before this, the wrapping paper feeding rollers 52 and the wrapping rollers 42, 43 and 44 are driven to rotate in accordance with their operation signals. Thus, the wrapping paper 32 is inserted between the stacked coins 26 and the wrapping rollers 42, 43 and 44.

When the coins of the selected denomination of the coin C to be wrapped are circular, the wrapping rollers 42, 43 and 44 are first operated at a relatively low speed $N_1$ to wind the wrapping paper 32 fed between the wrapping rollers 42, 43 and 44 and the stacked coins 26 around the stacked coins 26 to some extent. Thereafter, at the point A in FIG. 4, the operating speed of the wrapping rollers 42, 43 and 44 is changed to a speed $N_2$ which is double the speed $N_1$ so that the wrapping paper 32 is wound around the stacked coins 26 at high speed.

On the other hand, when the coins of the selected denomination are polygonal, the speed setting section or controller 124 sets the operation speed of the wrapping rollers 42, 43 and 44 at the point A and in the region after the point A to be about 55 percent of the speed $N_2$ in case of circular coins. As a result, since the wrapping rollers 42, 43 and 44 are operated at the speed $N_1$ in the region before the point A and are operated at the speed of about 55 percent of the speed $N_2$ at the point A and in the region after the point A while the stacked coins 26 are gripped between the wrapping rollers 42, 43 and 44, excess vibrations caused by the ups and downs on the circumferential surfaces of the stacked polygonal coins 26 can be prevented, and, therefore, the coins can be effectively prevented from flying out of the wrapping rollers 42, 43 and 44.

Further, in the coin wrapping machine 1 in accordance with the embodiment of the present invention, in case that the coin C to be wrapped is polygonal, the operating speed of the cam motor 74 is also decreased to about 55 percent of the speed in case of a circular coin at the point A and in the region after the point A where the operating speeds of the wrapping rollers 42, 43 and 44 are decreased to about 55 percent of the speed $N_2$. At the point and in the region after the point A, the crimp claws 56 come toward each other to approach the opposite end surfaces of the stacked coins 26 in order to crimp the opposite ends of the wrapping paper 32 by the operation of the cam motor 74. As explained above, in case of a polygonal coin, since the operating speeds of the wrapping rollers 42, 43 and 44 are decreased to about 55 percent of the speed $N_2$, the operating or moving speeds of the crimp claws are decreased proportionally to that of the wrapping rollers so that the operating or moving time of the crimp claws 56 becomes longer.

Therefore, enough time for the crimp claws 56 to crimp the opposite ends of the wrapping paper 32 can be obtained and a good crimp operation by the crimp claws 56 can be carried out.

Thus, the wrapping paper 32 is wound around the stacked coins 26 and both ends of the stacked coins 26, whereby a roll of wrapped coins 112 is finally produced. Thereafter, the wrapping rollers 42, 43 and 44 gripping the roll of wrapped coins 122 move away from each other and the roll of wrapped coins 122 drops down to a roll chute (not shown) disposed under the coin wrapping portion 30.

After the wrapped coins 112 are delivered to the roll shooter, the operation speed of the cam motor 74 is returned back to the normal speed, i.e., 100 percent speed.

In the above mentioned embodiment, in case of polygonal coins, the operating speeds of the wrapping motor 120 and the cam motor 74 are decreased to about 55 percent that used for circular coins. According to the present invention, other values may be employed instead of the above 55 percent decreased operating speeds. Further, according to the present invention, instead of the above 55 percent decreased operating speeds, the operating speeds of the wrapping motor 120 and the cam motor 74 may be individually set to respective values based on the respective shapes of the polygonal coins. The operating speed information can not only be stored in the ROM 130 in advance but can instead be input through the denomination selection section 2 or the like.

Further, in the coin wrapping machine 1 in accordance with the present invention, the operating speeds of the wrapping rollers 42, 43 and 44 may be set based on the diameters of the coins to be wrapped. In this case, the smaller the diameter of the coin is, the lower the operation speeds of the wrapping rollers 42, 43 and 44 are set to be, and the larger the diameter of the coin is, the higher the operating speeds of the wrapping rollers 42, 43 and 44 are set to be. At the same time, the moving speeds of the crimp claws 56 are set to be low or high in proportion to the operating speeds of the wrapping rollers 42, 43 and 44. Thus, the operating speeds of the wrapping rollers 42, 43 and 44 and the moving speeds of the crimp claws 56 are set based on the diameters of the coins to be wrapped. As a result, the stacked coins 26 can be more uniformly crimped.

Still further, the coin wrapping machine 1 in accordance with the present invention may further include a quality discrimination section 132 for discriminating the paper quality of the wrapping paper 32, as shown in FIG. 5. The paper quality is discriminated by a paper quality discrimination sensor (not shown) or an input to the paper quality discrimination section 132 by the operator. Since different wrapping papers are usually used for denominations of coins and/or in different countries, there may be cases when the wrapping paper can not be wrapped around the stacked coins at a high operating speed. More specifically, the wrapping paper may tear or the crimp claws may not be able to move close to the stacked coins during the high speed operation. Accordingly, in the coin wrapping machine 1 of the present invention, the operating speeds of the wrapping rollers and the moving speeds of the crimp claws are set based on the quality of the wrapping paper.

While the present invention has been illustrated by means of several preferred embodiments, one of ordinary skill in the art will recognize that modifications and improvements can be made while remaining within the spirit and scope of the invention. The scope of the invention is determined solely by the appended claims.

What is claimed is:

1. A coin wrapping machine comprising:

coin denomination selecting means for selecting a denomination of coins to be wrapped;

coin discrimination and counter means responsive to said coin denomination selecting means for discriminating and counting the coins whose denomination is selected by the coin denomination selecting means;

coin stacking means positioned relative to said coin discrimination and counter means for stacking a predetermined number of coins discriminated and counted by the coin discrimination and counter means to produce columnar stacked coins;

coin wrapping means for wrapping a wrapping paper around the stacked coins and crimping both ends of the wrapping paper to produce wrapped coins, said coin wrapping means including a plurality of wrapping rollers which rotate about longitudinal shafts thereof while contacting a circumferential surface of the stacked coins, wrapping roller drive means coupled to at least one of the wrapping rollers for rotating the wrapping rollers at a rotation speed selected from among a plurality of rotation speeds, crimping means for crimping the wrapping paper of the stacked coins by moving close to both ends of the wrapped stacked coins, and crimping means drive means for moving the crimping means at a moving speed selected from among a plurality of moving speeds; and speed setting means for setting the rotation speed for rotating the wrapping rollers to said selected rotation speed and for setting the moving speed of the crimping means to said selected moving speed by controlling the wrapping roller drive means and the crimping means drive means, wherein said selected moving speed has a predetermined relationship to said selected rotation speed.

2. A coin wrapping machine in accordance with claim 1, wherein said speed setting means sets a lower rotation speed of the wrapping rollers and a lower moving speed of the crimping means when the coin whose denomination is selected by the coin denomination selecting means is a polygonal coin relative to the rotation speed and moving speed set when the coin is a circular coin.

3. A coin wrapping machine in accordance with claim 1, wherein said speed setting means reduces the rotation speed of the wrapping rollers and the moving speed of the crimping means upon the wrapping rollers being moved into contact with the circumferential surface of the stacked coins.

4. A coin wrapping machine in accordance with claim 1, wherein said speed setting means sets the rotation speed of the wrapping rollers and the moving speed of the crimping means to predetermined respective speeds based on the individual denominations of the coins.

5. A coin wrapping machine in accordance with claim 1, wherein said speed setting means sets a higher rotation speed of the wrapping rollers and a higher moving speed of the crimping means as a diameter of the coins to be wrapped increases.

6. A coin wrapping machine in accordance with claim 1, further comprising paper quality discrimination means for discriminating the wrapping paper, said speed setting means setting the rotation speed of the wrapping rollers and the moving speed of the crimping means based on the paper quality discriminated by the paper quality discrimination means.

* * * * *